US005180080A

United States Patent [19]

Geschwender

[11] Patent Number: 5,180,080

[45] Date of Patent: Jan. 19, 1993

[54] DISPENSER AND METHOD OF VIEWING GRANULAR DRY MATTER AS IT IS BEING DISPENSED

[76] Inventor: Robert C. Geschwender, 3855 Orchard St., Lincoln, Nebr. 68503

[21] Appl. No.: 634,513

[22] Filed: Dec. 27, 1990

[51] Int. Cl.[5] ..... G01F 11/00

[52] U.S. Cl. ..... 222/1; 222/424; 222/457

[58] Field of Search ..... 222/1, 158, 142.1, 192, 222/196.1, 205, 424, 424.5, 457, 457.5, 480, 565, 568, 454; 73/426, 427, 429; 206/528, 534, 540

[56] References Cited

U.S. PATENT DOCUMENTS

| | | | |
|---|---|---|---|
| 1,642,425 | 9/1927 | Miller | 222/457 |
| 1,890,522 | 12/1932 | Maillard | 222/565 |
| 1,950,505 | 3/1934 | Matters | 222/567 |
| 2,635,790 | 4/1953 | Roberge | 222/424.5 |
| 2,645,382 | 7/1953 | Plough | 222/565 |
| 2,770,403 | 11/1956 | Eckley | 222/424.5 |
| 3,409,188 | 11/1988 | Wright | 222/565 |

*Primary Examiner*—Andres Kashnikow
*Assistant Examiner*—Philippe Derakshani
*Attorney, Agent, or Firm*—Vincent L. Carney

[57] ABSTRACT

To control the dispensing of granular dry matter, the upper face of a flange extending from the perforations in the top of a dispenser for granular dry matter is positioned substantially in a horizontal plane and the dispenser is shaken. The granular dry matter is dispensed from the container through a channel in the flange containing the perforations, over the upper face of the flange and observed by the user. The amount of granular dry matter on the upper face may be added to by further shaking the dispenser while briefly tilting it slightly so that the output end of the upper face is below its feed end. The amount of granular dry matter on the upper face may be reduced by shaking the dispenser while briefly tilting it so that the output end of its upper face is slightly above its feed end so that the granular dry matter falls into the channel and back into the container.

7 Claims, 4 Drawing Sheets

DISPENSER AND METHOD OF VIEWING GRANULAR DRY MATTER AS IT IS BEING DISPENSED

BACKGROUND OF THE INVENTION

The invention relates to a dispenser for dispensing granular dry material which flows readily, such as for example, a spice.

In one class of dispenser for granular dry material, a container for the granular dry material includes a perforated surface. To dispense the granular dry material, a person at least partly inverts the container and shakes it with the perforated surface facing at least partly downwardly so that the granular dry material slowly is forced through the perforations. After an amount of dry material has been dispensed that is sufficient for the person, that person returns the dispenser to a position with the perforated surface facing upwardly. An example of this type of dispenser is a salt shaker.

In one prior art dispenser of this class, the person dispensing the dry material watches it fall and accumulate outside of the dispenser, and after the person observes that a sufficient amount has been dispensed from watching the material fall and/or accumulate, stops shaking the dispenser and returns it to a position in which the perforated surface faces upwardly. This type of prior art dispenser does not provide any mechanism that permits viewing the amount of dry material that has passed through the perforations until it is falling from the container. Accordingly, some individuals who for health reasons, such as high blood pressure, desire to control and limit their sodium consumption, first pour the salt into one of their hands and then add it to the food so they can view the amount of salt before adding it to the food Prior art dispensers of this type have several disadvantages, such as for example: (1) the dispensers are not adapted to substantially regulate the dispensing of granulated dry matter; (2) they do not permit the learning of the amount of dry matter that is being dispensed until it is too late because the material is already falling; (3) dispensers that do not have clearly transparent wall portions, or the walls of which become discolored and lose their transparency do not permit easy determination of the type of material in the container; and (4) they do not permit the easy varying of the flow rate of the dry material being dispensed because they cannot transfer excess material back into the container.

SUMMARY OF THE INVENTION

Accordingly, it is an object of the invention to provide a novel dispenser of granular dry matter.

It is another object of the invention to provide a novel method of dispensing granular dry matter.

It is still another object of the invention to provide a novel method of varying the flow rate of granular dry matter being dispensed from a dispenser.

It is still another object of the invention to provide a novel dispenser which includes a container and a cap having a planar flange which extends beyond the openings of the cap.

It is still another object of the invention to provide a novel dispenser which includes a container and a cap having a flange with side walls on opposite sides thereof and a planar upper face positioned adjacent to the openings of the cap.

It is still another object of the invention to provide a novel method of dispensing dry matter such as spice in which the dry matter is dispensed from a container over a planar flange face having a color significantly contrasting with the color of the dry matter so that it is readily observed by the user.

It is still another object of the invention to provide a novel method of dispensing granular dry matter while it is observed by the user.

It is still another object of the invention to provide a novel method of dispensing granular dry matter that permits it to be observed by the user before it falls onto a surface.

It is still another object of the invention to provide a novel method of dispensing dry matter from a container through a channel and over a planar upper face of the flange in which the amount to be dispensed is controlled by slowly forcing the dry matter onto the flange, observing the amount on the flange until the desired amount is on the flange and then permitting the dry matter to fall.

It is still another object of the invention to provide a novel method of dispensing dry matter from a container through a channel and over a planar upper face of the flange in which the amount to be dispensed is controlled by slowly forcing the dry matter onto the flange, observing the amount on the flange and reducing the amount of dry matter to the desired amount by shaking of the dispenser while briefly tilting the flange slightly so that at least a portion of the flange is above the container.

In accordance with the above and further objects of the invention, a dispenser of granulated dry matter includes a first surface having perforations through which said dry matter can pass and a second surface positioned to receive said dry matter after it has passed through said perforations and holds it against falling when the dispenser is in at least one of a plurality of first positions but to permit it to fall when the dispenser is in at least one of a a plurality of second positions. Advantageously, the means for holding is of a different color than said granular dry matter and the means for holding includes a surface having at least a portion at an angle to the first surface.

For convenience, the first and second surfaces are formed on a cap for a container and the container can serve as a spice dispenser, such as a salt or pepper shaker. The first surface includes means for permitting the granular dry matter to fall from the dispenser in at least one of said second positions of the dispenser and to drop back into the container in one of said first positions.

In the preferred embodiment, the first surface is generally perpendicular to the axis of the container so that it is above the container when the container is at rest. The second surface is formed on walls of a flange. The second surface and walls extend from the first surface at an angle thereto substantially beyond the spice dispensing openings of the cap and end in a channel or trough containing the perforations. The perforations are spaced from each other a sufficiently small distance so that dry matter does not accumulate between the perforations and the perforations themselves are funnel shapped, opening upwardly to more easily receive the dry matter.

The dry matter is dispensed through the perforations from the container into the channel, and from the channel over a planar upper face of a flange where the amount of spice to be dispensed from the upper face is educed. The flange should be at least one-quarter inch in length and the trough should extend at least ninety percent of the distance between the side walls. The perforations should occupy at least fifty percent of the top surface of the trough at the top and preferably be funnel shaped but large enough at the bottom to receive the granules of dry matter. The diameter of circular perforations opening into the trough is larger than the diameter at the bottom opening into the container and the trough should be at least as deep as one-half diameter of the granules of dry matter.

The dispenser has a container and a cap with a flange adapted to make the spice readily visible. The cap color substantially contrasts with the color of the spice, so that during dispensing as spice passes over the flange, the rate and amount of spice being dispensed is readily visible. When the dispenser is placed in an upright position, any spice remaining on the flange falls back into the container.

In use, the upper face is positioned substantially in a horizontal plane and the dispenser is shaken. Spice is dispensed from the container through the channel, over the upper face of the flange and observed by the user. The amount of spice on the upper face may be added to by further shaking the dispenser while briefly tilting the upper face slightly so that its output end is below its feed end. The amount of spice on the upper face may be reduced by shaking of the dispenser while briefly tilting the upper face slightly so that its output end is above its feed end.

From the above description , it can be understood that the dispenser of this invention has several advantages, such as for example: (1) the dry matter can be viewed to determine the amount to be dispensed and its type before actually dispensing it; (2) it is sufficiently attractive to serve as a spice dispenser; and (3) the rate of dispensing can be conveniently controlled with it.

SUMMARY OF THE DRAWINGS

The above and further features of the invention will be more fully understood from the following detailed description when considered with reference to the accompanying drawings in which.

DETAILED DESCRIPTION

Figure 1:
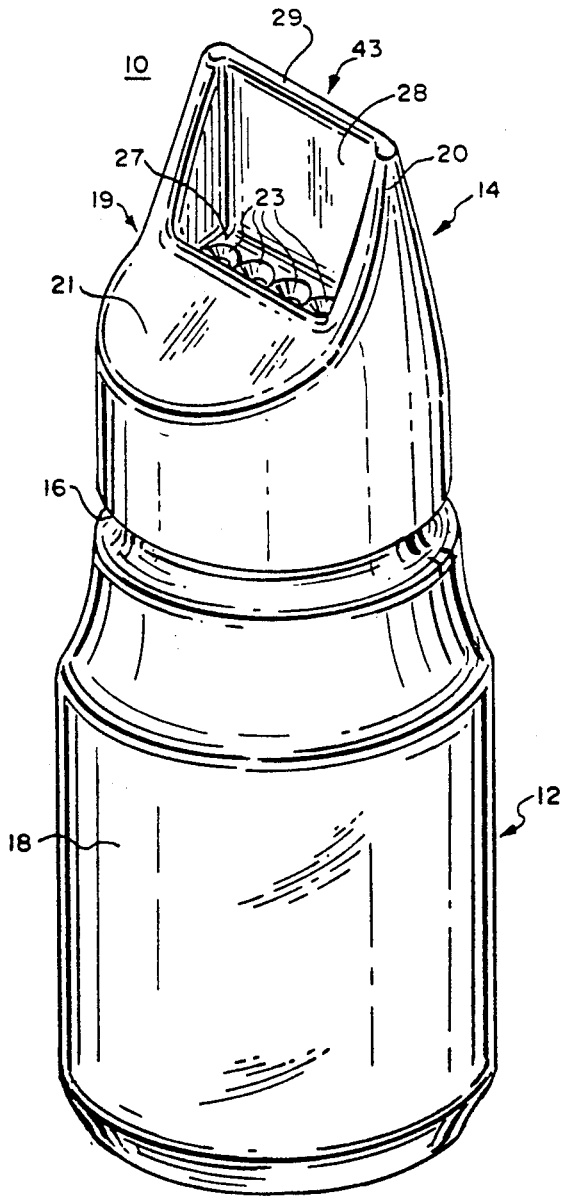
FIG. 1 is a front perspective view of an embodiment of a dispenser in accordance with the invention.

In FIG. 1, there is shown a perspective view of a spice dispenser 10 including a container 12 and a cap 14. The container 12 is not part of the invention except to the extent that it cooperates with the cap 14 and any container capable of holding dry granular material and of being closed by the cap 14 is suitable. The purpose of the container 12 is to hold a reservoir of granulated dry matter for dispensing as needed through the cap 14.

In the preferred embodiment, the container 12: (1) is transparent; (2) is generally cylindrical; and (3) includes a fastener portion 16 and body portion 18. The fastener portion 16 is adapted to removably connect the body portion 18 to the cap 14.

The cap 14 includes, as its principal parts: (1) a first surface indicated generally at 19 having side walls 20, an open end of perforations, holes or channels 23 through which the dry matter can pass; and (2) a second surface 28 positioned to receive said dry matter after it has passed through said perforations 23 to serve as a means for preventing the dry matter from falling when held generally level or at a small angle from the horizontal.

While in the embodiment of FIG. 1, the means for holding the dry matter after it leaves the container is a surface extending at an angle from the perforations 23 with retaining sides, it could be curved upwardly at its end so that the dispenser 10 has open sides. It holds the dry matter against falling when the dispenser 10 is in at least one of a plurality of first positions but permits it to fall when the dispenser is in at least one of a plurality of second positions. Advantageously, the means for holding is of a different color than said granular dry matter and the means for holding includes a surface having at least a portion at an angle to the first surface.

For convenience, the first and second surfaces 19 and 28 are integrally formed on the plastic cap 14 and the container 12 can hold spice so that the combination serves as a spice dispenser, such as a salt or pepper shaker. The first surface 19 includes a trough or depression 27 containing the holes 23 near or against the second surface 28 that serves as a means for permitting the granular dry matter to fall from the dispenser in at least one of said second positions of the dispenser and to drop back into the container 12 in one of said first positions.

In the preferred embodiment, the first surface 19 is generally perpendicular to the axis of the container 12 so that it is above the container 12 when the container 12 is at rest. The second surface 28 is formed between walls 20 of a flange 43 extending to an open end 29 perpendicular to the longitudinal axis of the container 12 and in line with the holes 23. The second surface 28 and walls 20 extend from the first surface 19 at an angle thereto substantially beyond the spice dispensing openings 23 of the cap 14 and end in the trough 27 containing the perforations 23. The perforations 23 are spaced from each other a sufficiently small distance so that dry matter does not accumulate between the perforations 23 and the perforations 23 themselves are funnel shaped, opening upwardly to the surface of the trough 27 to more easily receive the dry matter from the second surface 28 when it is desired to return it into the container 12.

The dry matter is dispensed through the perforations 23 from the container 12 into the trough 27, and from the trough 27 over a planar upper face of the flange 43 where the amount of spice to be dispensed from the upper face is educed. The flange 43 should be at least one-quarter inch in length and the trough 27 should extend at least ninety percent of the distance between the side walls 20. The perforations 23 should occupy at least fifty percent of the top surface of the trough 27 at the top and preferably be funnel shaped but large enough at the bottom to receive the granules of dry matter. The diameter of circular perforations opening into the trough 27 is larger than the diameter at the bottom opening into the container 12 and the trough 27 should be at least as deep as one-half diameter of the granules of dry matter.

The cap 14 is adapted to make the dry matter readily visible and for this purpose the color of the flange surface of the cap 14 substantially contrasts with the color of the dry matter so that if salt is dispensed, the flange 43 is a dark color and if pepper is dispensed, the cap is a light color. With this mechanism, during dispensing, as spice passes over the flange 43, the rate and amount of spice being dispensed is readily visible. When the dispenser is placed in an upright position, any spice remaining on the flange 43 falls back into the container.

Figure 2:
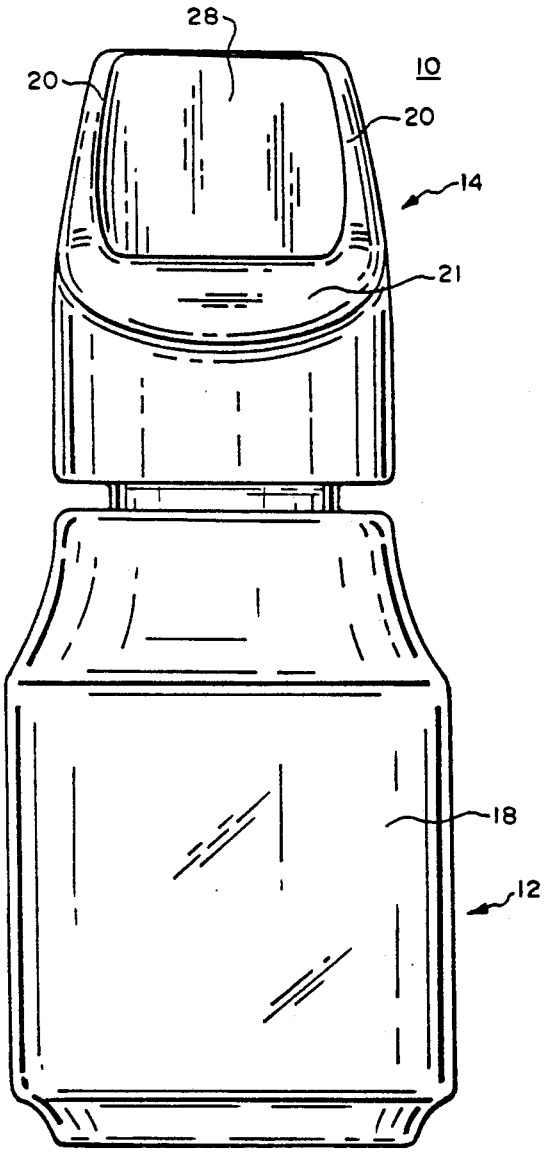
FIG. 2 is a front elevational view of the embodiment of the dispenser of FIG. 1.
Figure 3:
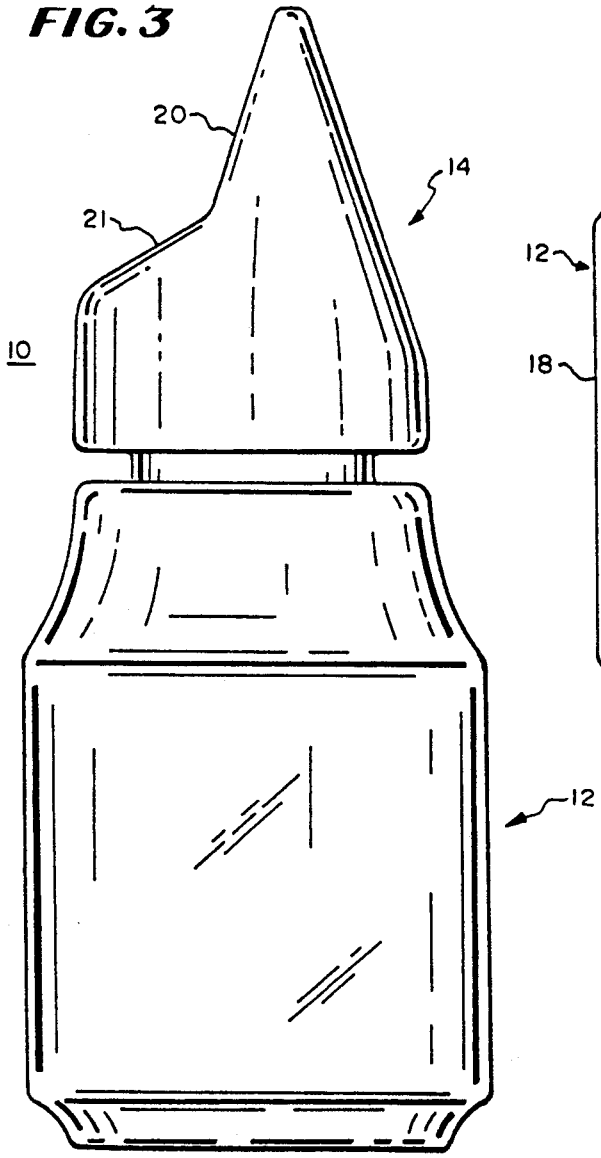
FIG. 3 is a side elevational view of the embodiment of the dispenser of FIG. 1.

As best shown in the front elevational view of FIG. 2 and the side elevational view of FIG. 3, the first surface 19 (FIG. 1) includes the depressed trough 27 (FIG. 1) and an angled cut away portion 21 that permits easy viewing of the second surface 28. In the preferred embodiment, the cut away portion 21 makes an angle of approximately 60 degrees with respect to the longitudinal axis of the container 12 and extends downwardly when the container 12 is upright with its longitudinal axis vertical.

Figure 4:
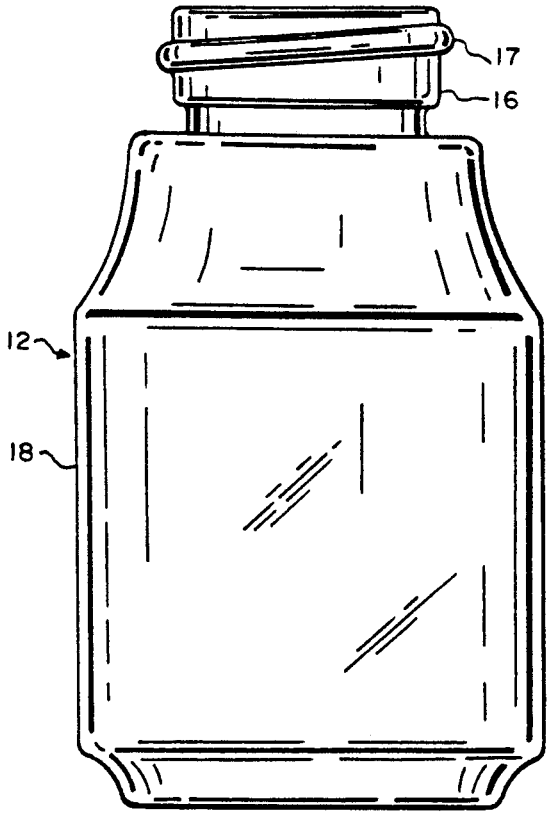
FIG. 4 is a side elevational view of the container of the embodiment of the dispenser of FIG. 1.
Figure 5:
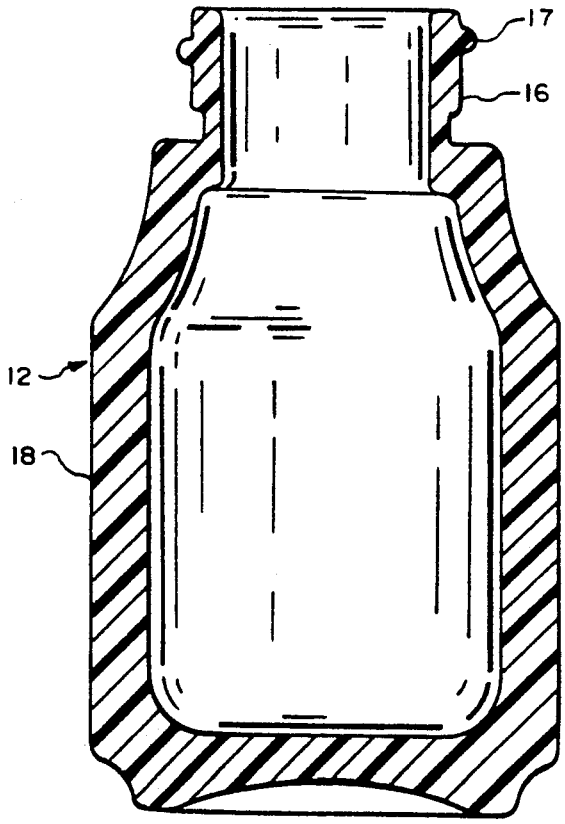
FIG. 5 is a cross-sectional side view of the container of the embodiment of the dispenser of FIG. 1.

In FIGS. 4 and 5, there is shown an elevational view and a sectional view respectively of a typical container 12 having a body portion 18 having side walls and a bottom wall adapted to contain granular dry matter and having an open top with fastening means 16 including threads 17 therearound. The external threads 17 are adapted to engage internal threads on a bottom opening 35 (FIG. 7) of the cap 14 to permit communication between the interior of the container 12 and the interior of the cap 14.

Figure 6:
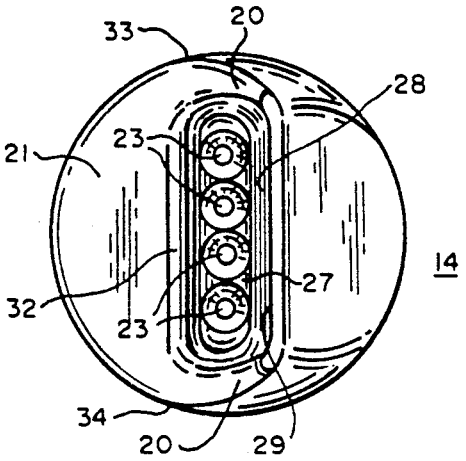
FIG. 6 is a top view of the embodiment of the dispenser cap of FIG. 1.

In FIG. 6, there is shown a top view of the cap 14 with the upper surface 28, side walls 20, holes 23 and cut away portion 21. The boundary between the cut away portion 21 and the trough 27 is formed as a flat section 32. As shown in this view, the holes 23 face upwardly when the container 12 rests on its bottom with the cap 14 upwardly and the holes 23 are each parallel to the longitudinal axis of the container 12 (FIG. 1).

Figure 7:
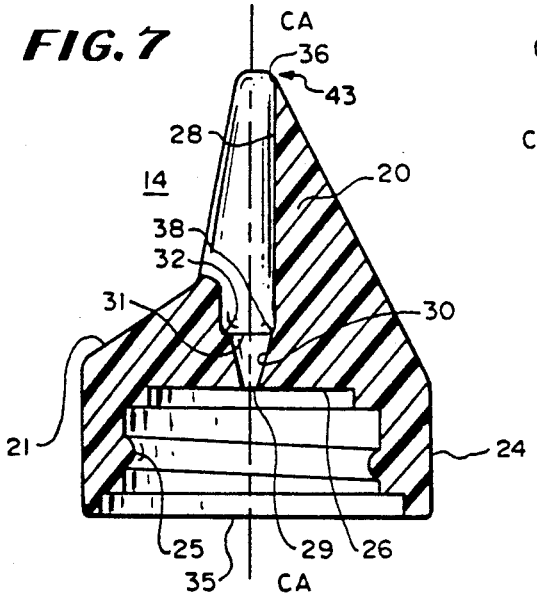
FIG. 7 is a cross-sectional side view of the embodiment of the dispenser cap of FIG. 1.

In FIG. 7, there is shown an elevational sectional view of the cap 14 with the flange 43 (FIG. 1), side walls 20, a body portion 18 (FIG. 1) and a threaded portion 24 about the interior of an opening 35. The flange 43, the body portion 18 and the threaded portion 24 are integrally connected. The threaded portion 24 has inner threads 25. The threaded portion 24 has a chamber wall 26. The flange 43 has an upper face 28.

The cap 14 has at least one channel enclosed by a channel wall 30 extending therethrough. Each channel wall 30 has a feed end 29 and an output end 31 and extends between the chamber wall 30 and the upper face 28 of the flange 43. The channel wall 30 may be the interior of one of several holes 23 (FIG. 6) or a single elongated slot or any other suitable opening.

The threaded portion 24 of the cap 14 is adapted to be positioned over the fastening means 16 of the container 12. The cap 14 has the threaded portion 24 having inner threads 25. The container 12 has the fastening means 16 having the outer threads 17. In assembled position, the inner threads 25 of the cap 14 engage outer threads I7 (FIGS. 4 and 5) of the container 12 to hold the cap 14 to the container 12.

Each channel wall 30 is conical with its smaller diameter at feed end 29, and its larger diameter at output end 31. Trough 27 (FIG. 6) is positioned adjacent to output end 31 at the base of upper face 28 and includes space between the output ends 31 of the holes 23 (FIG. 6) that is sufficiently narrow so that it does not hold a significant amount of the granular dry matter and the walls of the trough 27 slope downward and provide insufficient level space in directions perpendicular to the trough 27 and line of holes 23 and at the ends along this line to hold a significant amount of granular dry matter. Thus, when the spice dispenser 10 is returned to its upright position after use, any spice remaining on upper face 28 passes into trough 27 through output ends 31 and feed ends 29 into the container 12.

Figure 9:
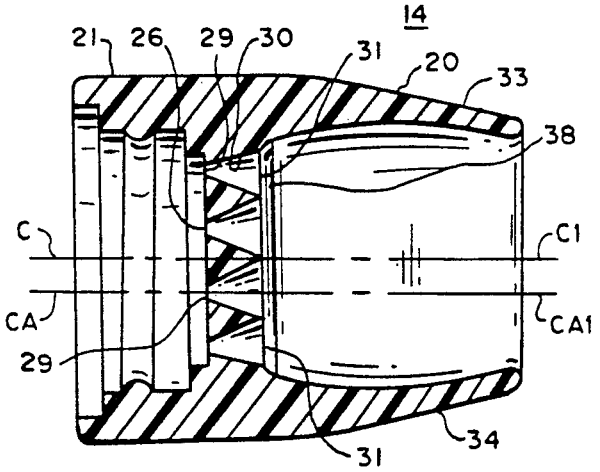
FIG. 9 is a cross-sectional front view of the embodiment of the dispenser cap of FIG. 1.

Adjacent to the upper face 28 are side walls 33 and 34 (FIGS. 6 and 9). The channel enclosed by the channel wall 30 has a central channel axis CA-CA1, a portion of which extends adjacent to upper face 28. Flange 43 extends outwardly from output end 31 in a direction generally perpendicular to the channel axis and to the line of holes 23. Upper face 28 is adjacent to the central axis CA-CAl.

Figure 8:
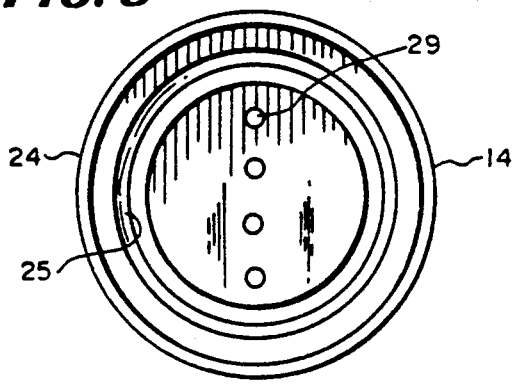
FIG. 8 is a bottom view of the embodiment of the dispenser cap of FIG. 1.

In FIG. 8, there is shown a bottom view of the cap 14 having inner threads 25 communicating with the interior of the container 12 (FIG. 1) and a plurality of openings 29 in the feed side of the cap 14 to receive the granulated dry matter. These openings are aligned along a central diameter of the inner threads 25 and of the corresponding opening in the container 12 and sufficient in number and size to receive granulated dry matter in the quantities appropriate for the particular material.

In FIG. 9, there is shown a sectional view of the cap 14 taken through the line of openings 29 showning the funnel shaped walls 30 sloping to occupy most of the trough 27. While the holes 23 (FIG. 6) form a right regular truncated cone in the preferred embodiment, they of course may assume other shapes such as angles, cones or holes having a square cross section of changing size since they are only intended to be large enough to receive sufficient material on the feed end 29 to collect material on the output end 31 when the container 12 is upright and not clog with material.

Figure 10:
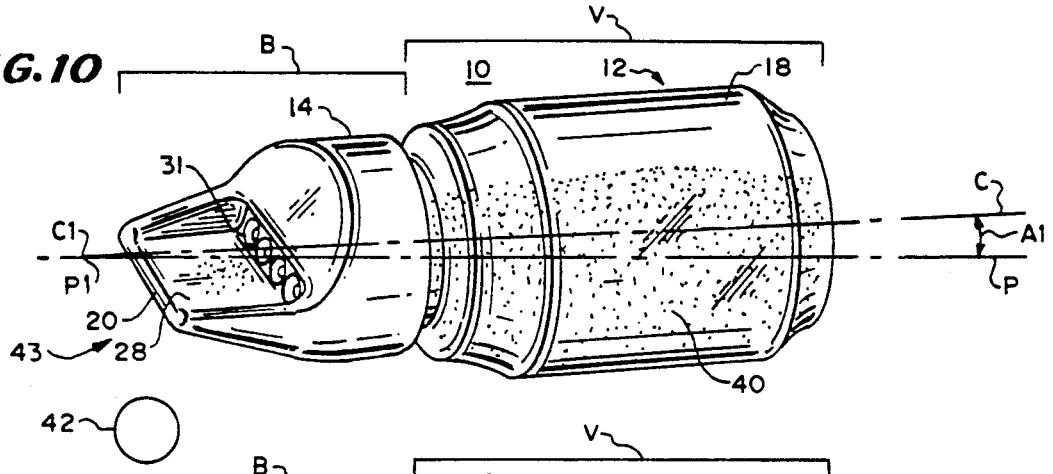
FIG. 10 is a perspective side view of the embodiment of the dispenser of FIG. 1 tilted slightly into a dispensing position.

In FIGS. 10–13, there is shown a development illustrating the operation of the dispenser 10, with FIG. 10 showing it tilted slightly into dispensing position. In this position, the spice 40 or other granular dry material moves from the container 12 onto the upper surface 28 of the flange 43. The dispenser 10 is positioned so that its central axis C-Cl forms an angle Al with the horizontal line P-Pl. In this position, spice 40 is dispensed in controlled amounts from the upper surface 28 of the flange 43 onto food or other receiving surface 42.

The color of the cap 14 substantially contrasts with the color of the spice or other material 40, so that during dispensing as spice 40 passes over the upper surface 28 of flange 43, the amount being dispensed is readily visible. When the spice dispenser 10 is placed in an upright position, any spice 40 remaining on the flange 43 falls back through the output end 31 into the container 12.

The body portion 18 is generally cylindrical and has a central cap axis which is coaxial with central axis C-Cl. The central axis C-Cl has a B body portion circumscribed by the body portion 18 and a viewing portion V positioned adjacent to the body portion B.

Figure 11:
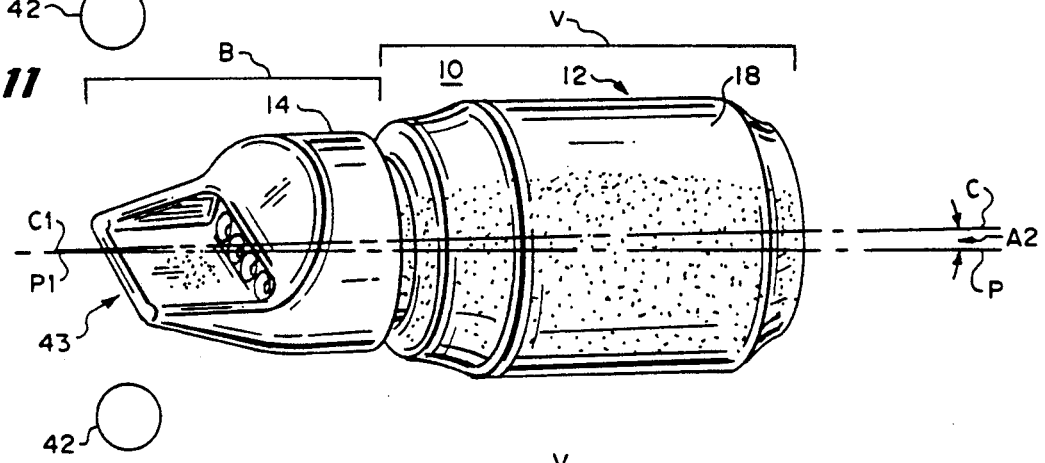
FIG. 11 is a perspective side view of the embodiment of the dispenser of FIG. 1 in a position for viewing the amount of spice to be dispensed.

By holding the spice dispenser 10 so that the upper face 28 is positioned in about a horizontal plane, the flow of spice 40 is stopped, and the amount of spice 40 to be dispensed is readily seen. In this position, the central axis C-Cl forms at most a small angle A2 with horizontal line P-Pl, as shown in FIG. 11.

Figure 12:
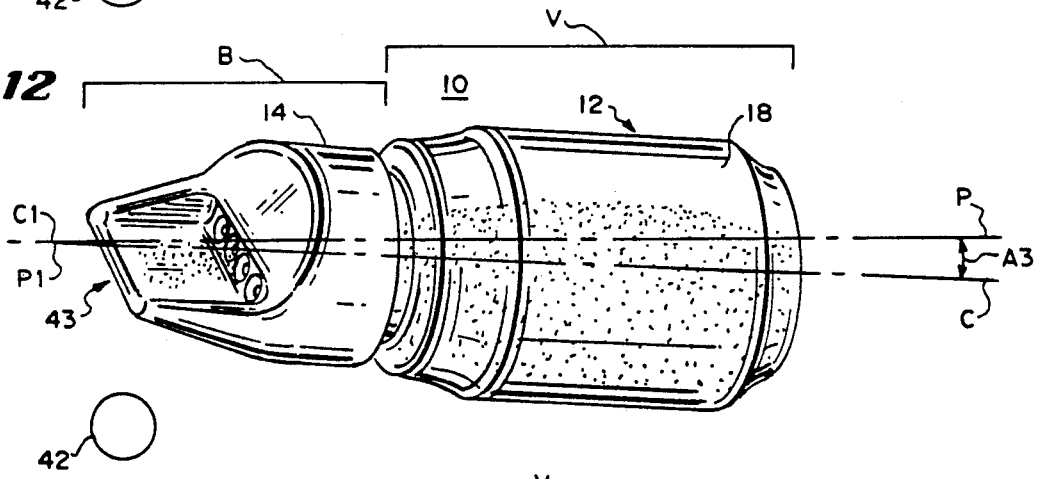
FIG. 12 is a perspective side view of the embodiment of the dispenser of FIG. 1 tilted slightly into a refilling position.
Figure 13:
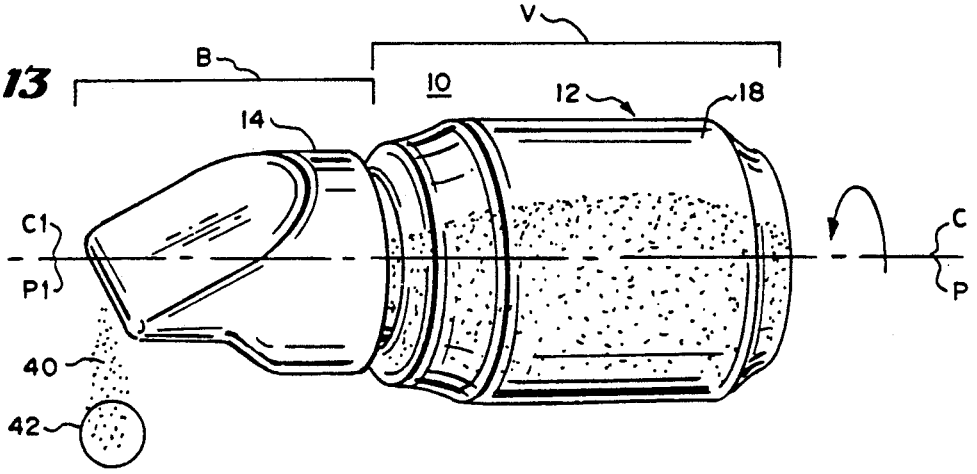
FIG. 13 is a perspective side view of the embodiment of the dispenser of FIG. 1 in a position for dispensing a predetermined amount of spice onto food by rotating the dispenser about 180 degrees around its central axis.

If less spice 40 is to be dispensed, then the spice dispenser 10 is tilted slightly into refilling position, as shown in FIG. 12. Spice 40 moves from the upper surface 28 into the container 12. Dispenser 10 is positioned so that its central axis C-Cl forms an angle A3 with horizontal line P-Pl. When the amount of spice 40 to be dispensed is on the upper surface 28 of flange 43, the spice 40 may be dispensed onto food, for example by rotating the dispenser 10 around its central axis C-Cl as shown in FIG. 13. The amount of rotation is preferably from about 30 to about 180 degrees.

Thus, in accordance with the method of the invention, spice 40 is dispensed from dispenser 10. During use, the container 12 contains spice 40. Spice 40 is dispensed from the container 12 through the channel and over planar upper face 28 of the flange 43 onto food 42 being seasoned. Spice 40 is retained on the upper face 28 by the side walls 33 and 34 (FIGS. 6 and 9).

Initially, the dispenser 10 is held in viewing position with the upper face 28 positioned substantially in a horizontal plane, and then shaken. Spice 40 is dispensed from the container 12 through the channel and over the upper face 28 of the flange 43 and observed by the user. The amount of spice 40 on the upper face 28 may be added to by further shaking of the dispenser 10 while briefly tilting the upper face 28 slightly so that its output end 31 (FIG. 14) is below its feed end 29. The amount of spice 40 on the upper face 28 may be reduced by shaking of the dispenser 10 while briefly tilting the upper face 28 so that its output end 31 is above its feed end 38.

In use, the upper face 28 is positioned substantially in a horizontal plane and the dispenser is shaken. Spice 40 is dispensed from the container 12 through the channel 30, over the upper face 28 of the flange 43 and observed by the user. The amount of spice 40 on the upper face 28 may be added to by further shaking of the dispenser while briefly tilting the upper face 28 slightly so that its output end 31 is below its feed end 29. The amount of spice on the upper face 28 may be reduced by shaking of the dispenser while briefly tilting the upper face 28 slightly so that its output end 31 is above its feed end 29.

From the above description, it can be understood that the dispenser of this invention has several advantages, such as for example: (1) the dry matter can be viewed to determine the amount to be dispensed and its type before actually dispensing it; (2) it is sufficiently attractive to serve as a spice dispenser; and (3) the rate of dispensing can be conveniently controlled with it.

While a preferred embodiment of the invention has been described with some particularity, many modifications and variations of the preferred embodiment are possible in the light of the above teachings. Therefore, it should be understood that, within the scope of the appended claims, the invention may be practiced other than as specifically described.

What is claimed is:

1. A container adapted to dispense granular dry matter comprising:

a dispensing surface;

a plurality of perforations in said dispensing surface through which said dry matter may pass from the interior of the container to the exterior;

means for temporarily holding the dry matter at a location where it is visible prior to permitting it to fall;

means for permitting the dry matter to drop back into the container upon changing a position of the container;

the plurality of perforations being spaced sufficiently close to each other to permit substantially all of the dry matter to fall back into the container in one position;

the means for permitting including a trough in the means for temporarily holding the dry matter at a location where it is visible;

said location where it is visible and trough being outside of the container;

some of said perforations being in said trough.

2. Apparatus according to claim 1 in which the tops of the perforations opening into the trough occupy at least 50 percent of the top surface of the trough.

3. Apparatus according to claim 2 in which said means for temporarily holding is a flange at least one-quarter inch in length.

4. Apparatus according to claim 2 in which said perforations in said trough are funnel shaped.

5. The container of claim 3 further comprising a first and a second side wall; each side wall being positioned along an opposite side of said flange.

6. The container of claim 1 wherein said container contains dry material which flow readily; said dispensing surface has a first color; said dry material has a second color; and said first color substantially contrasts with said second color.

7. A method of dispensing dry granular material comprising the steps of:

shaking a container with the dry granular material in it wherein the container has a surface with cone-shaped perforations having large open ends opening outwardly from the surface, said perforations being positioned during the shaking so that at least some of the perforations are below at least some of the dry granular material, whereby the dry granular material may pass through the perforations;

catching the cry granular material as the dry granular material passes through the perforations on a surface extending at one angle from the perforations with parallel side wall extending from it to hold the dry granular material between the parallel side wall and which permits viewing of the dry granular material;

permitting one portion of the dry granular material to fall from the dispenser; and permitting another portion of the dry granular material to fall back from the surface into the large open ends of perforations by changing the orientation of the shaker.

* * * * *